US007364211B2

(12) United States Patent
Niskanen et al.

(10) Patent No.: US 7,364,211 B2
(45) Date of Patent: Apr. 29, 2008

(54) VEHICLE LOCK CONTROLLED BY A SHAPE MEMORY ALLOY ACTUATOR

(75) Inventors: Jason David Niskanen, Scarborough (CA); Andrew R. Daniels, Newmarket (CA); Dragan Mrkovic, Newmarket (CA)

(73) Assignee: Intier Automotive Closures Inc., Newmarket, Ontario (CA)

( * ) Notice: Subject to any disclaimer, the term of this patent is extended or adjusted under 35 U.S.C. 154(b) by 41 days.

(21) Appl. No.: 10/988,911

(22) Filed: Nov. 15, 2004

(65) Prior Publication Data

US 2005/0146147 A1 Jul. 7, 2005

(51) Int. Cl.
*E05B 3/00* (2006.01)
*E05B 65/00* (2006.01)

(52) U.S. Cl. ..... 292/336.3; 292/92; 292/201; 292/216; 292/DIG. 23; 292/DIG. 65

(58) Field of Classification Search ..... 292/336.6, 292/201, 216, DIG. 23, DIG. 27, 336.3, 92, 292/DIG. 65; 70/224, 208, 278.1
See application file for complete search history.

(56) References Cited

U.S. PATENT DOCUMENTS 3,729,220 A * 4/1973 Andres ..... 292/336.3
4,465,311 A * 8/1984 Austin ..... 292/144
4,652,768 A 3/1987 Gmeiner et al.
4,762,348 A * 8/1988 Matsumoto ..... 292/201
4,929,007 A * 5/1990 Bartczak et al. ..... 292/336.3
5,077,992 A * 1/1992 Su ..... 70/107
5,123,687 A * 6/1992 Pfeiffer et al. ..... 292/336.3
5,549,337 A * 8/1996 McCulloch ..... 292/225
5,901,991 A * 5/1999 Hugel et al. ..... 292/201
6,026,705 A * 2/2000 Ficyk et al. ..... 74/500.5
6,082,153 A 7/2000 Schoell et al.
6,102,453 A 8/2000 Cetnar
6,131,989 A * 10/2000 Montone et al. ..... 296/146.8
6,142,540 A * 11/2000 Girard et al. ..... 292/216
6,206,452 B1 3/2001 Talbot
6,241,294 B1 * 6/2001 Young et al. ..... 292/336.3
6,341,807 B2 1/2002 Cetnar et al.
6,361,091 B1 * 3/2002 Weschler ..... 292/336.3
6,364,378 B1 4/2002 Humbert et al.
6,443,506 B1 * 9/2002 Su ..... 292/244
6,460,906 B2 * 10/2002 Bingle et al. ..... 292/336.3
6,485,081 B1 11/2002 Bingle et al.

(Continued)

FOREIGN PATENT DOCUMENTS

IT EP 1279784 * 1/2007

*Primary Examiner*—Carlos Lugo
(74) *Attorney, Agent, or Firm*—Clark Hill PLC

(57) ABSTRACT

A contractible shape memory alloy (SMA) wire is used to throw a lever in a latch. The SMA actuator provides weight and space savings. In one embodiment, the SMA actuator is incorporated in the handle of the latch in order to provide a child lock or double lock function. The handle has a lever which includes a relatively short slot leg and a relatively long slot leg. A toggle sits in the slot. At least one SMA wire is connected to the toggle to move it between the relatively short slot leg, wherein the lever is prevented from pivoting, and the relatively long slot leg, where the lever is enabled to pivot. In another embodiment, the SMA actuator is embedded in the latch itself, and used to throw a lever that controls the child lock function.

11 Claims, 13 Drawing Sheets

U.S. PATENT DOCUMENTS 6,497,436 B1 12/2002 DeBlock et al.
6,527,310 B1 3/2003 Bellamy
6,554,328 B2 4/2003 Cetnar et al.
6,554,329 B1 4/2003 DeBlock et al.
6,662,608 B1 * 12/2003 Baukholt ..... 70/264
6,692,056 B2 2/2004 Bingle et al.
7,017,345 B2 * 3/2006 Von Behrens et al. ..... 60/527
7,036,855 B2 * 5/2006 Lin et al. ..... 292/216
7,086,257 B2 * 8/2006 Bucker et al. ..... 70/256
2002/0139157 A1 10/2002 Butera et al.
2003/0094818 A1 5/2003 Tomaszewski et al.
2003/0177974 A1 * 9/2003 Dominique ..... 116/200
2005/0184533 A1 * 8/2005 Hebenstreit et al. ..... 292/201

* cited by examiner

VEHICLE LOCK CONTROLLED BY A SHAPE MEMORY ALLOY ACTUATOR

FIELD OF INVENTION

The invention generally relates to automobile locks and/or latches and more specifically to a vehicle lock controlled by a shape memory alloy actuator.

BACKGROUND OF INVENTION

Automobiles often include child locks for preventing doors, especially rear doors, from being opened from within the passenger compartment. Child locks are typically either manually activated or power actuated. Manually activated child locks typically have a lockout control mechanism that can only be accessed when the door is open. This creates an inconvenience in that if there is an adult in the rear seat and the child lock is engaged, then someone else must open the door for the adult passenger. Power child locks typically require an actuator and a lockout control mechanism which is located on the door latch. The main problem with these types of locks is the lack of packaging space in the door to facilitate the actuator and the lockout mechanism.

Accordingly, it would be desirable to have a remotely actuated child lock in which the driver can operate the rear child lock doors from the front seat. As the costs associated with a power child lock are high when compared to the value this feature adds to a vehicle, it is desirable to provide such a child lock at a minimum cost.

In addition, another desirable feature to include in a vehicle door latching or locking system is a "double lock", wherein, when engaged, both the inside and outside release levers are simultaneously inactive. This feature has conventionally been incorporated into the design of the latch itself, which can often necessitate a very expensive redesign of a pre-existing latch. Since the functions of a child lock and a "double lock" feature are quite similar, it would be desirable to provide a single structure that could provide both functions and thus further reduce costs.

SUMMARY OF INVENTION

One aspect of the invention provides a handle assembly which functions to enable or disable the door handle from actuating a latch rather than installing a lock assembly on the latch itself. In order to reduce packaging requirements and still keep costs low, the actuating mechanism preferably employs a wire, formed from a shape memory alloy, which is able to contract and expand in order to activate the locking function.

In accordance with the foregoing aspect of the invention, a first embodiment of a handle assembly is described which includes a housing having a door handle lever pivotably mounted therein. The lever has a slot formed therein which includes a relatively short slot leg and a relatively long slot leg. A toggle is mounted to the housing. The toggle includes a tab which seats in the slot of the lever. At least one selectively contractible wire is connected to the toggle in order to move the tab between the relatively short slot leg, wherein the lever is prevented from pivoting, and the relatively long slot leg, wherein the lever is enabled to pivot. The handle assembly may be utilized for a child lock function or for a double lock function.

Preferably, the short slot leg is situated generally orthogonal to the relatively long slot leg. The toggle is pivotably mounted to the housing and includes an arm from which the tab depends. A spring is connected to the housing for biasing the toggle arm to first and second positions required to insert the tab into the short and long slot legs of the door handle lever. When the tab is situated in the relatively long slot leg of the fleet this, the handle is enabled to actuate a latch and the tab can ride in the long slot leg as the door handle lever is rotated. When the tab is situated in the short slot leg, the handle is disabled such that the door handle lever is prevented from moving and actuating the latch.

Preferably, the wire is formed from a shape memory alloy (SMA). A first section of the SMA wire is electrically connected between a first terminal and the toggle and a second section of the SMA wire is electrically connected between a second terminal and the toggle. A controller is provided for selectively contracting the first section of wire (and in the process lengthening the second section of wire) and selectively contracting the second section of wire (and in the process lengthening the first section of wire), thereby selecting moving the tab between the first and second legs of the lever slot.

A second embodiment of a handle assembly is also described wherein the door handle lever is always movable but may or may not be enabled to release the latch. According to this embodiment, the latch is directly coupled to an intermediate latch release lever and the door handle lever is selectively coupled to the intermediate release lever by a floating pin and a link/toggle lever which is actuated by one or more contractible wires.

Preferably, the handle assembly according to the second embodiment includes a housing and a door handle lever pivotably mounted to the housing. The door handle lever has a slot and therein which includes a first slot leg (short slot leg) and a comparatively longer second slot leg (long slot leg). An intermediate latch release lever having a slot therein is pivotably mounted to the housing. A link/toggle lever having a slot therein is also pivotably mounted to the housing and movable between first and second positions. A pin is floatingly disposed in the slots of the door handle lever, the intermediate latch release, and the link/toggle lever. At least one selectively contractible wire is connected to the link/toggle lever in order to move it between the first position, wherein the pin is forced into the short slot leg so as to kinematically couple the door handle lever to the intermediate latch release lever, and the second position, wherein the pin is forced into the long slot leg such that the door handle lever is not kinematically coupled to the intermediate latch release lever.

A second aspect of the invention relates to an improved latch having a built-in child lock or double lock mechanism which is activated by throwing a lever, the improvement comprising at least one contractible wire for throwing the lever.

BRIEF DESCRIPTION OF DRAWINGS

The foregoing and other aspects of the invention will be better understood from the following detailed description of preferred embodiments thereof in conjunction with the drawings, wherein.

DETAILED DESCRIPTION OF PREFERRED EMBODIMENTS

Figure 1:
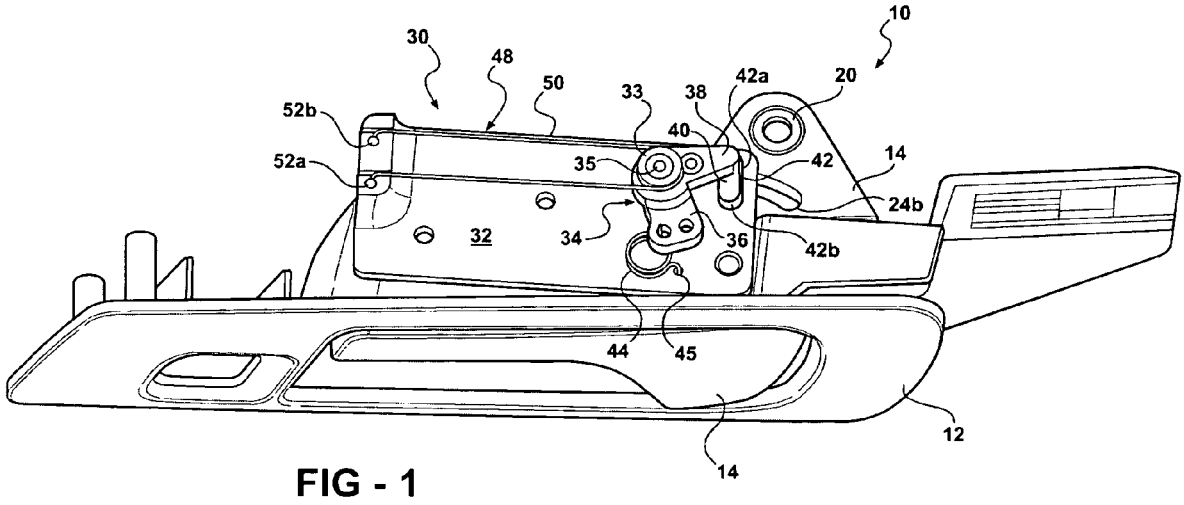
FIG. 1 is a perspective view of a door handle and child lock assembly according to a first embodiment with the child lock disengaged and a door handle lever in a rest position.
Figure 1A:
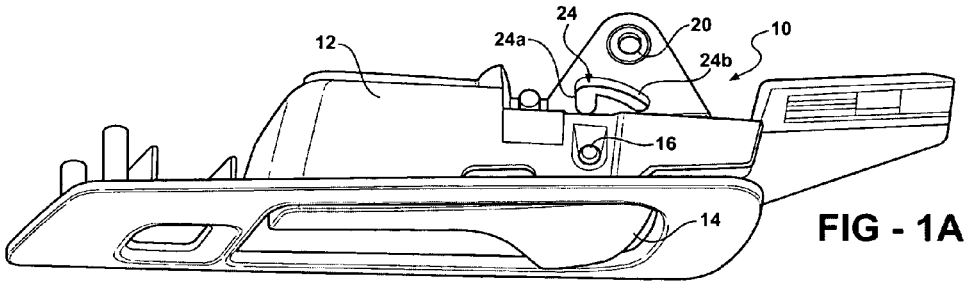
FIG. 1A is the same view of the assembly shown in FIG. 1 but with a shape memory alloy actuator removed from the illustration.
Figure 2:
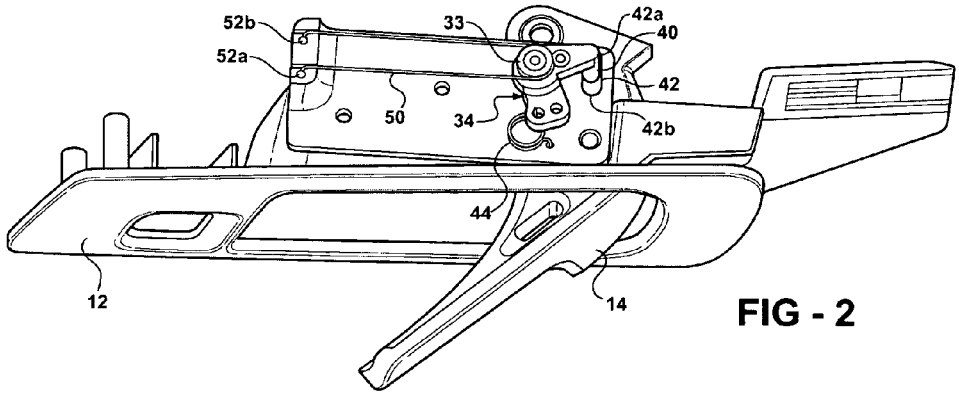
FIG. 2 is a perspective view of the assembly shown in FIG. 1 with the child lock disengaged and with the door handle lever in a pulled (activated) position.
Figure 2A:
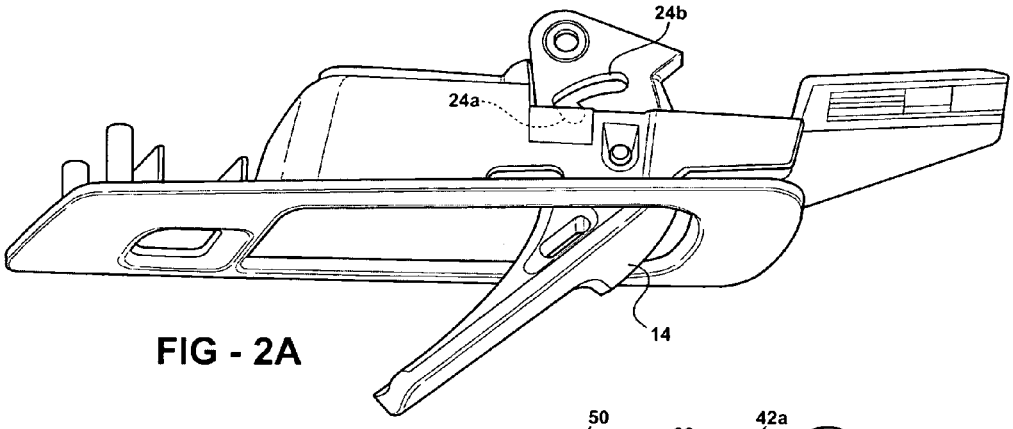
FIG. 2A is the same view of the assembly shown in FIG. 2 but with the shape memory alloy actuator removed from the illustration.
Figure 4:
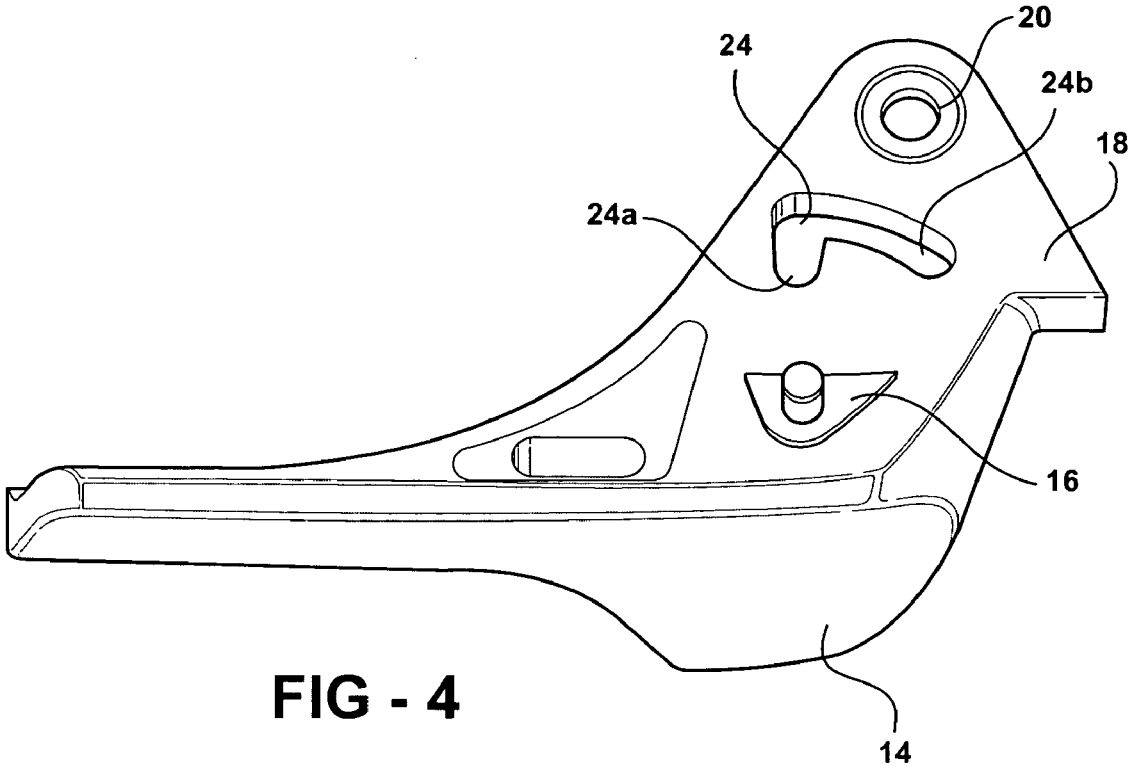
FIG. 4 is an isolated perspective view of the door handle lever shown in FIG. 1.

FIG. 1 shows a door handle and child lock assembly 10 according to a first preferred embodiment which includes a housing 12 mountable to an automobile door as well known in the art. The assembly 10 includes a door handle lever 14, which is shown in isolation in FIG. 4. The door handle lever 14 includes a pin 16 that extends upwardly from a planar structure 18 of lever 14. The pin 16 seats in an aperture of the housing 12, as seen best in FIG. 1A, thereby enabling the door handle lever 14 to pivot from a rest position shown in FIG. 1 to a pulled (or activated) position shown in FIG. 2, provided the handle is enabled as discussed in greater detail below. The door handle lever 14 includes a connector 20 which is used to affix a control rod or other linkage (not shown) between the door handle lever 14 and the latch of the vehicle door (not shown). Thus, in this embodiment, rotation of the door handle lever 14 will unlatch the door. In what follows, the assembly 10 is described in the context of a child lock in which case the child lock is said to be "disengaged" when the handle is enabled and "engaged" when the handle is disabled. Those skilled in the art will understand from the description that follows that the assembly 10 can be readily employed for use in a double lock function.

Figure 3:
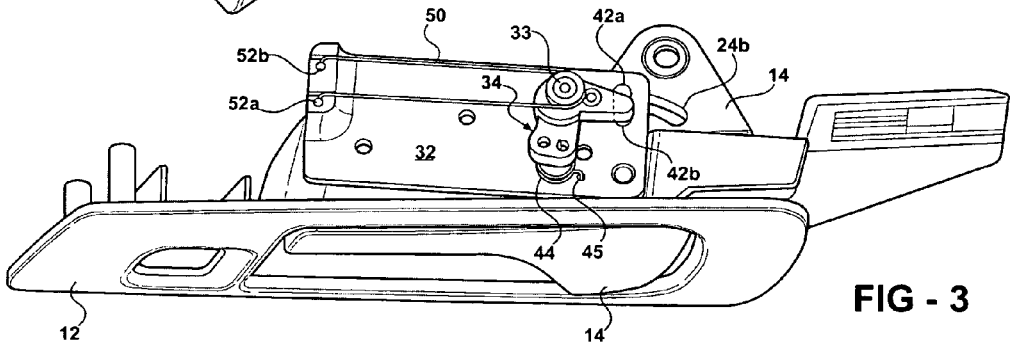
FIG. 3 is a perspective view of the assembly shown in FIG. 1 with the child lock engaged.
Figure 5:
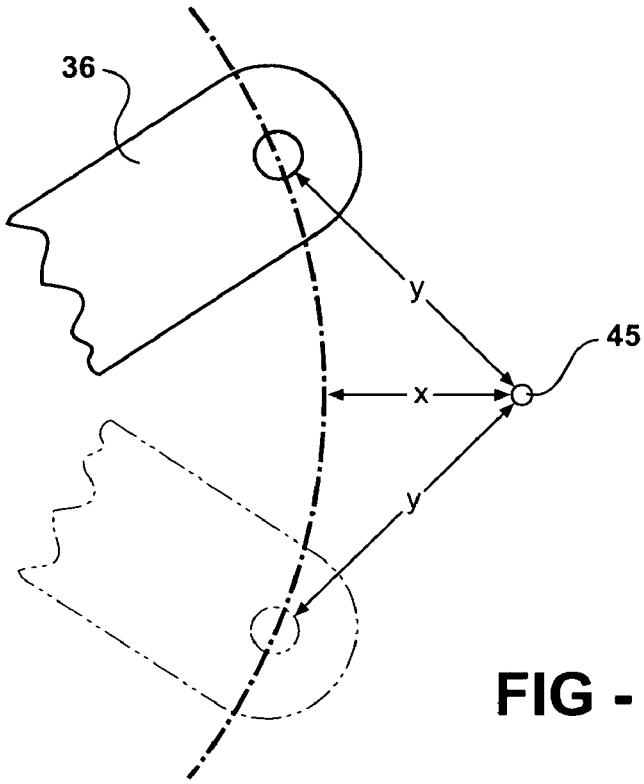
FIG. 5 is a schematic diagram illustrating the kinematics of a toggle mechanism shown in FIG. 1.
Figure 6:
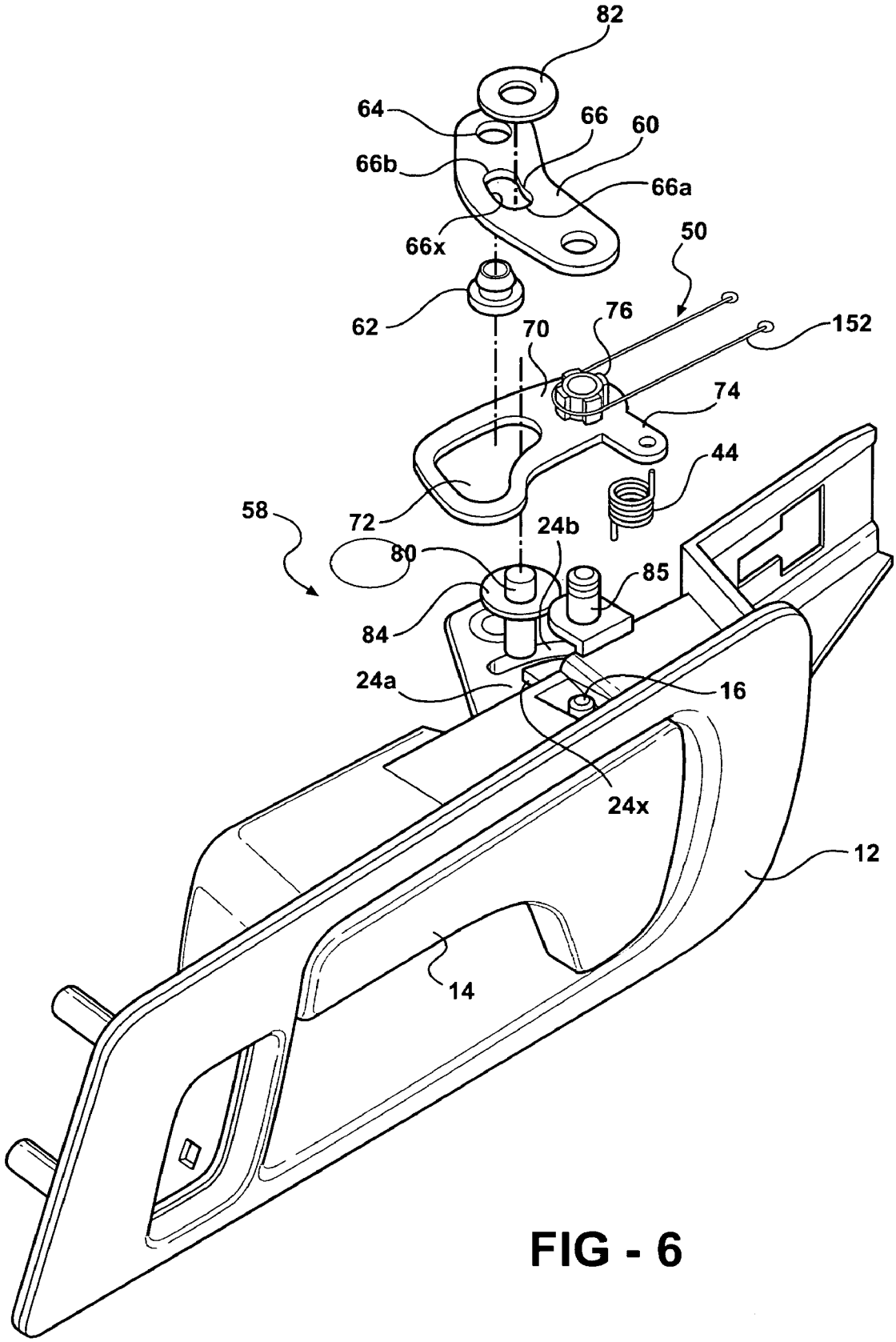
FIG. 6 is an exploded view of a door handle and child lock assembly according to a second embodiment.

In order to provide a lockout, the door handle lever door 14 includes a slot 24 (seen best in FIG. 4) having a first leg 24*a* and a second leg 24*b* which is disposed generally orthogonal to the first leg 24*a*. The child lock includes an actuator 30 (FIG. 1) comprising a plate 32 mounted to the housing 12. A toggle 34 comprising a sleeve 33 is pivotably mounted to a post 35 extending from the plate 32. The toggle 34 includes two arms 36 and 38 integrally formed with the sleeve 33. Arm 38 includes a pin or tab 40 which extends through an aperture 42 formed in the plate 32 in order to engage slot 24 of handle lever 14. The aperture 42 of plate 32 is sized and oriented similar to the first leg 24*a* of slot 24. Arm 36 is connected to one end of a spring 44 which has the other end thereof attached to the plate 32. The toggle 34 pivots between first and second positions. In the first position as shown in FIG. 1, the tab 42 is located at a first end 42*a* of aperture 42 and the child lock is disengaged. In the second position as shown in FIG. 3, the tab 42 is located at an opposite and 42*b* of the aperture 42 and the child lock is engaged. The toggle 34 is forced into these two positions only as a result of the spring 44. More particularly, as seen in FIG. 5, arm 36 follows an arcuate path as indicated by the stippled line. When the arm 36 is at the midpoint of its travel path, the distance x between the arm 36 and a fixation point 45 of the spring of 44 is at its shortest point. At this position the spring 44 is compressed and thus the arm 36 is urged to one side or the other of the midpoint until the arm 36 reaches at the end of its arcuate path of travel. At the end of travel, the distance y between arm 36 and the fixation point 45 of spring 44 is such that that the spring is in its rest state. It will be understood that as soon as the toggle 34 is actuated to move past the midpoint x it will be urged to reach its closest end of travel position.

The actuator 30 includes a wire 50 constructed from a shape memory alloy (SMA) that is able to contract and expand and is used to set or position the toggle 34. The SMA wire 50 is fixed at its two ends to two terminals 52*a* and 52*b* that are electrically isolated from one another. The wire 50 is also fixedly wound around the electrically conductive sleeve 30 of toggle 34. In its rest state the sleeve/terminal 33 and each of the terminals 52*a* and 52*b* are connected to a voltage source (typically the vehicle battery). In order to actuate the child lock, a controller (not shown) selectively connects one of the terminals 52*a* or 52*b* to ground. For example, if terminal 52*a* is connected to ground then the section of SMA wire 50 extending from the sleeve/terminal 33 to terminal 52*a* will contract (and in the process expand or lengthen the other section of wire 50), causing the toggle 34 to pivot such that tab 40 is moved from aperture end 42*a* to end 42*b*, as shown in FIG. 3. When this happens, the tab 40 is situated within the first leg 24*a* of the door handle lever 14. This engages the child lock. In this position, the door handle lever 14 cannot be moved or rotated as a result of tab 40 being lodged in the short leg 24*a*, and consequently the latch cannot be unlatched by pulling on the door handle lever 14.

When terminal 52*b* is connected to ground, the section of SMA wire 50 extending from the sleeve/terminal 33 to terminal 52*b* is contracted (and in the process expanding or lengthening the other section of the wire 50), causing the tab 40 to move back to position, as shown in FIG. 1. In this position the tab 40 is located in leg 24*b* of slot 24. This disengages the child lock. In this position, the handle lever 14 may be rotated (as shown in FIG. 2) as a result of the relatively long length of leg 24*b* in which tab 40 rides. Rotation of the door handle lever 14 will unlatch the latch, as previously described.

In the embodiment described above, the door handle lever 14 is prevented from moving when the child lock is engaged. In a second embodiment described below with reference to FIGS. 6-10, the door handle lever is always movable. This is made possible by directly coupling of the latch to an intermediate latch release lever and selectively coupling the door handle lever to the intermediate release lever via a link lever and the floating pin. When the child lock is engaged, the door handle lever is kinematically coupled to the latch release lever (and thus enabled) and when the child lock is disengaged the door handle lever is kinematically uncoupled from the latch release lever (and thus disabled).

More particularly, FIGS. 6-10 show a door handle and child lock assembly 58 in which door handle lever 14 is connected to a latch release lever 60 and a link/toggle lever 70 via a floating pin 80. The latch release lever 60 is pivotally mounted to the pin 16 of housing 12, which is the same point about which the door handle lever 14 pivots. In this embodiment, however, the control rod, cable or linkage that is used to unlatch the latch (not shown) is connected to the latch release lever 60 via a rivet 62 mounted in aperture 64. The pin 80 rides in slot 66 of the latch release lever 60. A washer 82 is welded or otherwise fixed to the pin 80 above lever 60.

The link/toggle lever 70 is pivotally mounted to a post 85 located on housing 12 via a sleeve 76 integrally formed with lever 70. The link/toggle lever 70 includes an extending arm 74 and spring 44 is connected between this arm and housing 12 in order to provide a toggle mechanism similar to that described above which forces the link/toggle lever 70 into one of two positions, described in greater detail below. An SMA wire 50 is wrapped around the sleeve 76 and is mounted to two electrically isolated end terminals (not shown), providing contractible wire sections 151 and 152. The pin 80 is fitted into a slotted aperture 72 of lever 70 and a second washer 84 is welded to or otherwise fixed to the pin 80 below lever 70.

The pin 80 also rides in the dual-legged slot 24 of handle release lever 14.

Figure 7:
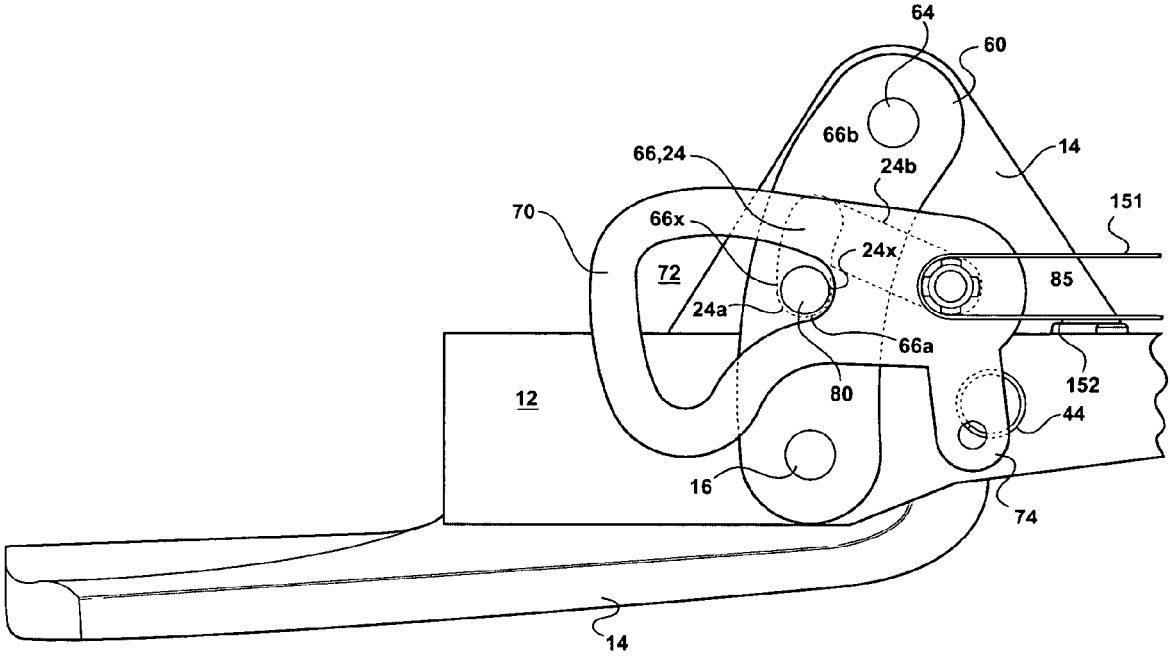
FIG. 7 is a plan view of the assembly shown in FIG. 6 with the child lock disengaged and a door handle lever in the rest position.
Figure 8:
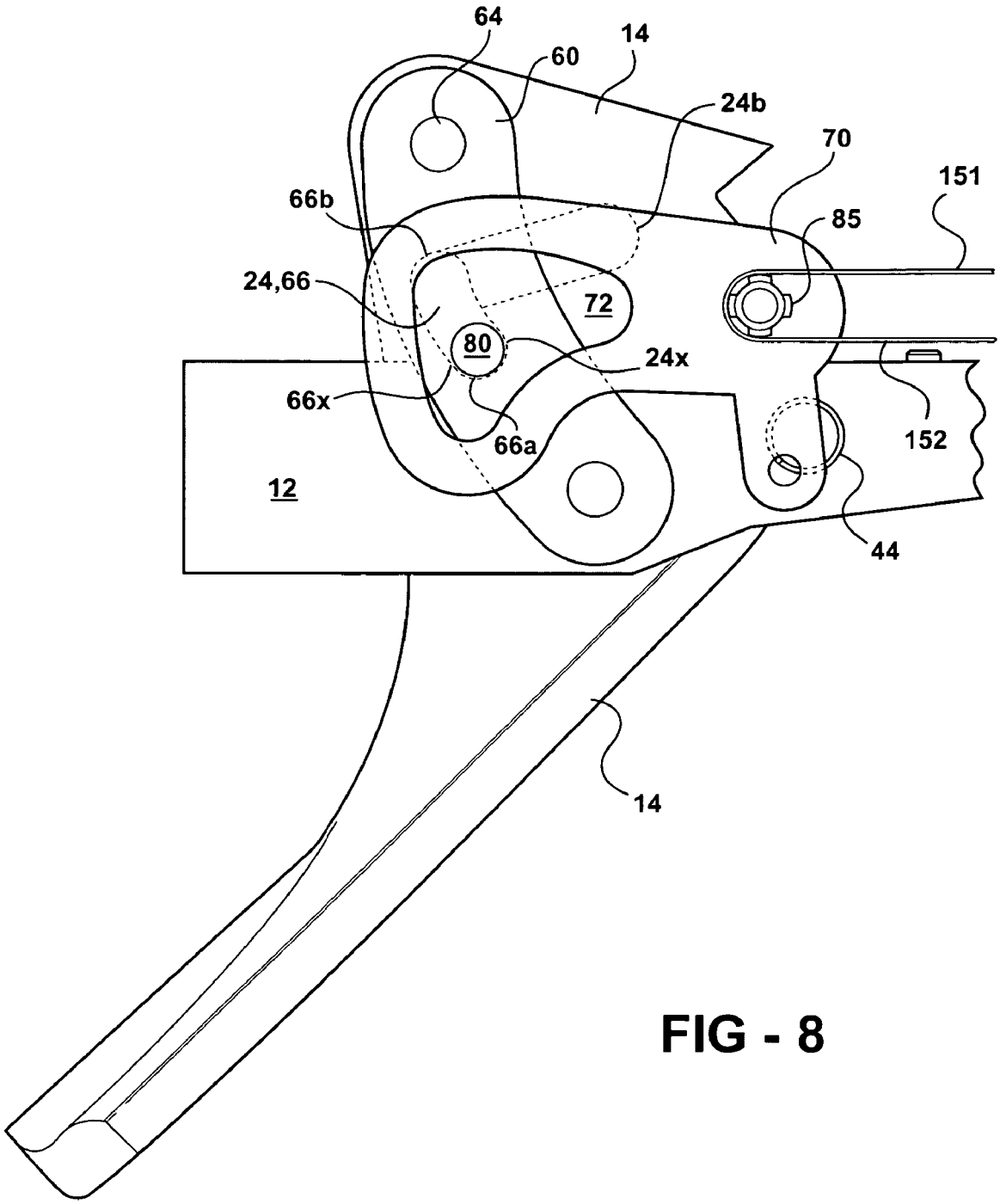
FIG. 8 is a plan view of the assembly shown in FIG. 6 with the child lock disengaged and the door handle lever in a pulled position.

FIG. 7 shows the assembly 58 with the handle release lever 14 enabled (i.e., the child lock is disengaged) and in the closed position. In this state, the toggle/link lever 70 is in a first position which forces the pin 80 into the short slot leg 24*a* of the handle release lever 14. In this position, the pin 80 is located in a first end 66*a* of slot 66 of latch release lever 60. When the handle release lever 14 is pulled, wall section 24*x* of slot leg 24*a* pushes against the pin 80 which, in turn, pushes against wall section 66*x* of the latch release lever 60. Consequently, the latch release lever 60 will pivot as indicated, causing the pin 80 to ride in and along slot 72 of the link/toggle lever 70 until the pin 80 reaches the end of the slot 72, as shown in FIG. 8.

Figure 9:
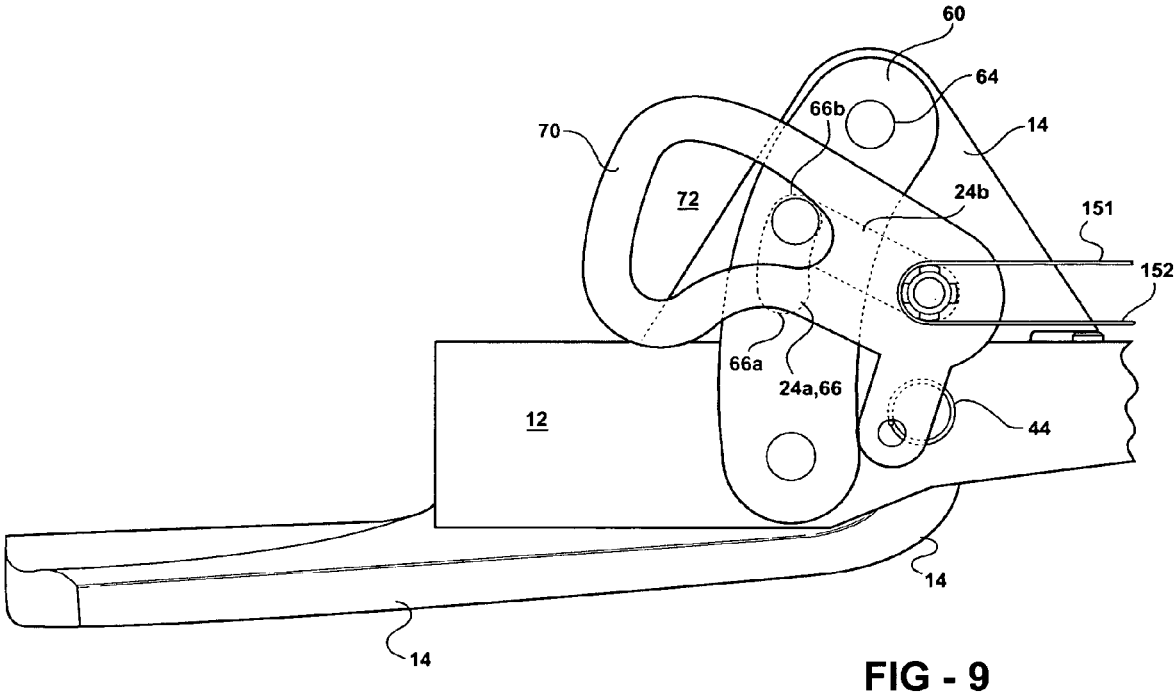
FIG. 9 is a plan view of the assembly shown in FIG. 6 with the child lock engaged and the door handle lever in the rest position.
Figure 10:
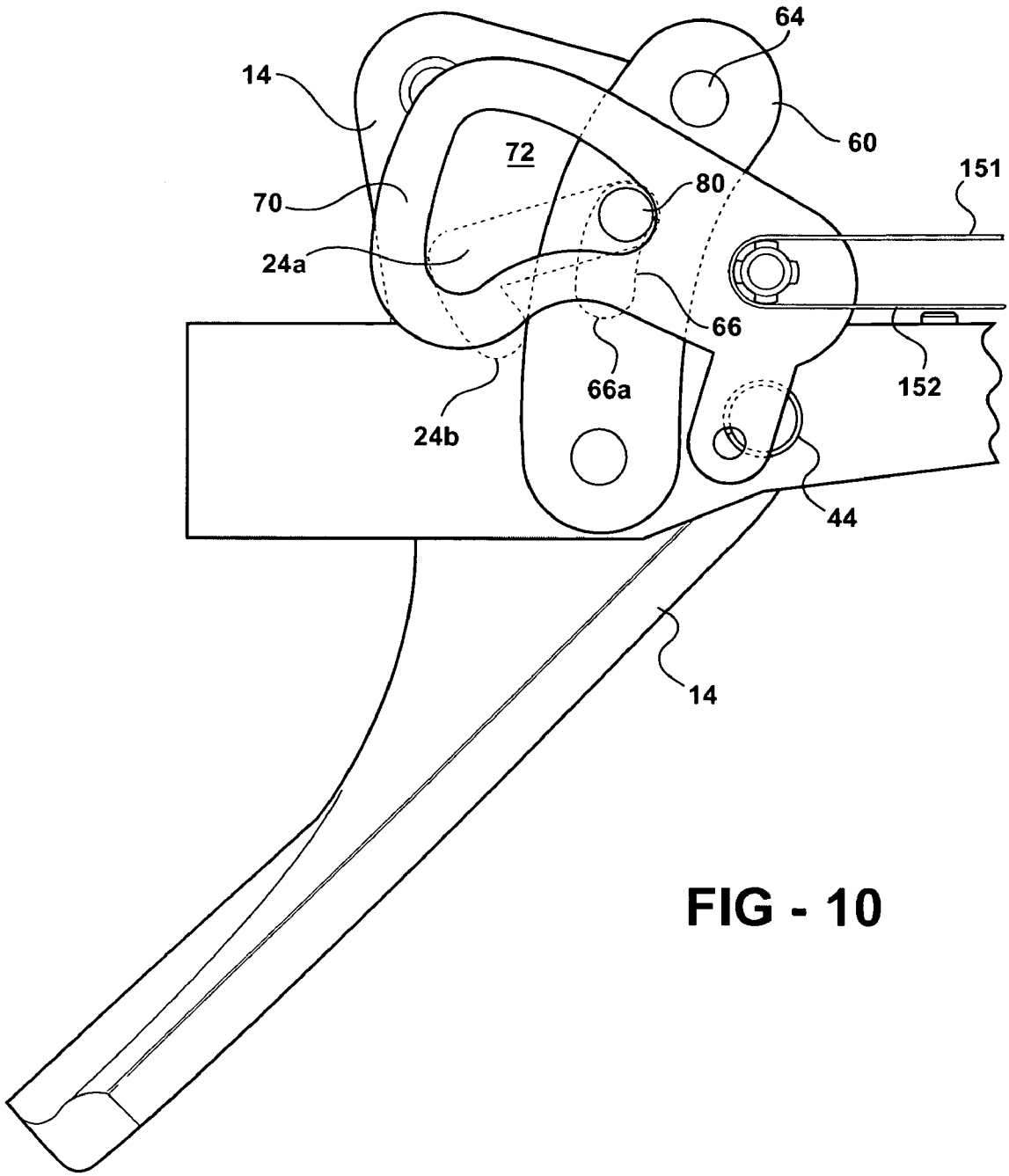
FIG. 10 is a plan view of the assembly shown in FIG. 6 with the child lock engaged and the door handle lever in the pulled position.

FIG. 9 shows the assembly 58 with the handle release lever 14 disabled (i.e., the child lock is engaged) and in the closed position. In this state, the toggle/link lever 70 is in a second position in which the pin 80 is forced into the long slot leg 24*b* of the handle release lever 14. In this position, the pin 80 is located in a second end 66*b* of slot 66 of the latch release lever 60. When the handle release lever 114 is pulled, the pin 80 stays stationary because it is located in the log slot leg 24*b* which does not have a wall to push the pin, and thus as the handle release lever 114 is pulled the slot leg 24*b* moves relative to the stationary pin 80 as shown in FIG. 10, without moving the latch release lever 60.

In a manner similar to the first embodiment described above, the sleeve 76 is set to a predetermined voltage and the end terminal of each wire section 151, 152 is selectively switched between this voltage or ground. The switches are controlled by a controller (not shown) which establishes the current flow in wire sections 151 and 152 in order to selectively actuate the link/toggle lever 60 to the first or second positions in accordance with a command signal.

Figure 11:
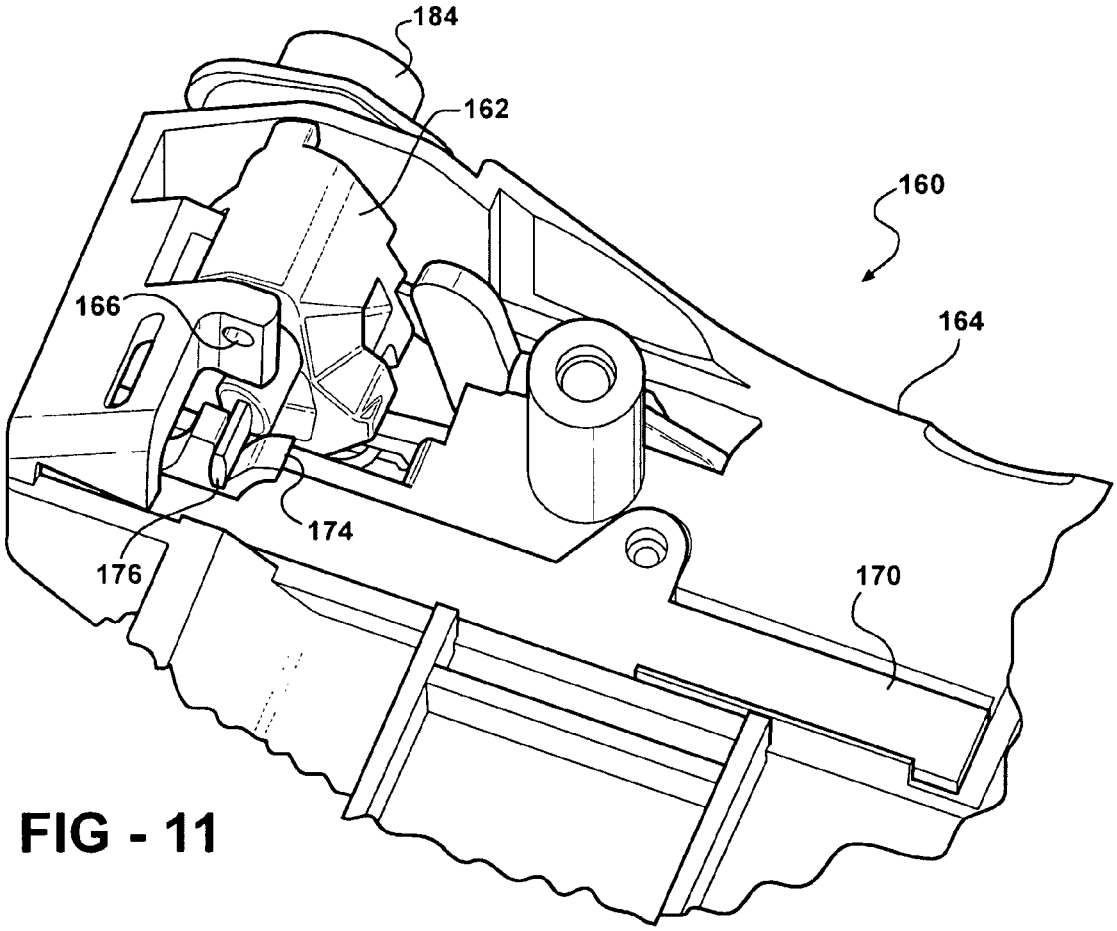
FIG. 11 is a perspective view of a latch having a child lock lever which is actuated using shape memory (SMA) wires, according to a third embodiment.
Figure 12A:
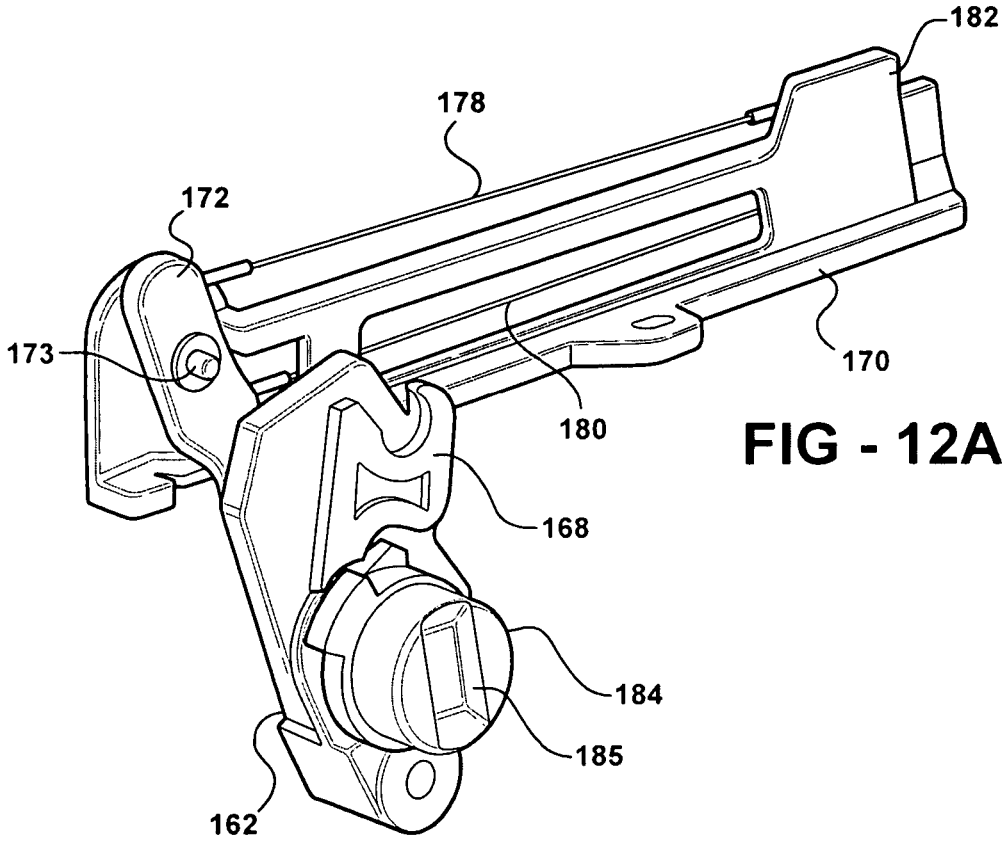
FIGS. 12*a* and 12*b* are isolated and opposing perspective views of a SMA subassembly mounted within the latch shown in FIG. 11.
Figure 12B:
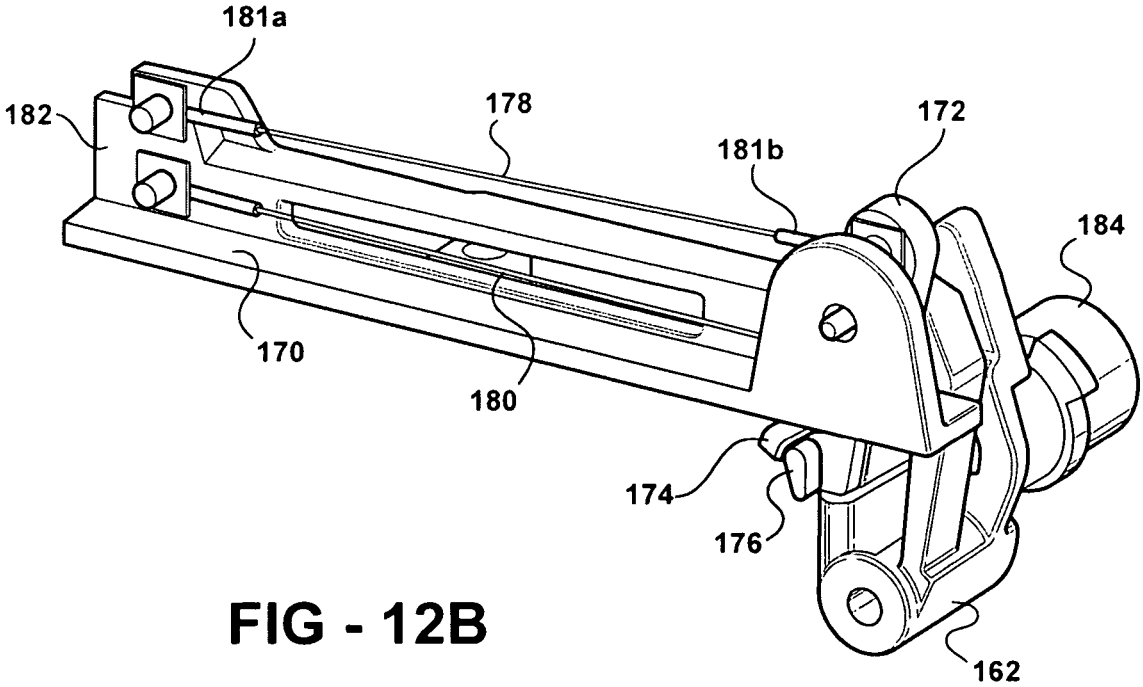

Referring now to FIGS. 11, 12*a* and 12*b*, a third embodiment of the invention is shown. In this embodiment, the shaped memory actuator is mounted to the latch housing and directly pivots a child lock lever between a locked and an unlocked position. Latch 160 includes a child lock lever 162 pivotally mounted to latch housing 164 via a child lock pin 166. Child lock lever 162 is movable between a locked and an unlocked position. As can more clearly be seen in FIG. 12*a*, a claw 168 on child lock lever 162 retains an end of a lock link lever (not shown). By pivoting child lock lever 162 between the locked and unlocked positions, the lock link lever kinematically couples or decouples the inner door handle from the release lever (also not shown). The inner door handle can also be decoupled in order to provide a double-locking feature, if desired. A toggle spring (not shown) may be used to bias the child lock lever 162 to the locked or unlocked positions, if desired.

Retained within latch housing 164 is a SMA subassembly 170. SMA subassembly 170 provides a mounting structure for the SMA wires and terminals. While the SMA subassembly shown in FIG. 12 is mounted to latch housing 164, it is also contemplated that the SMA subassembly 170 could also be integrally formed from latch housing 164. A power child lock lever 172 is pivotally mounted to SMA subassembly 170 via a post or pin 173. A claw 174 on power child lock lever 172 is hooked around a post 176 extending from a planar surface of child lock lever 162, kinematically coupling the motion of the two levers 162, 172 so that pivoting one lever pivots the other lever as well. A SMA wire 178 and a SMA wire 180 are each connected to terminals 181*a* and 181*b* at a first end located on a terminal end 182 of SMA subassembly 170, and at a second end to power child lock lever 172 respectively. Each of SMA wire 178 and SMA wire 180 are electrically isolated from each other, and can be selectively and alternatively grounded. Thus, by activating either SMA wire 178 or SMA wire 180, power child lock lever 172 can be pivoted in a first or second direction to either the locked position disabling operation of the door handle lever or the unlocked position enabling operation of the door handle lever.

A manual child lock knob 184 extends out from a planar surface of child lock lever 162 through a hole (not shown) in latch housing 164 to the exterior of latch 160. Child lock knob 184 includes a slot 185, allowing child lock knob 184 and thus, child lock lever 162 to be manually rotated (typically with a slotted screwdriver). SMA wires 178 and 180 provide only minimal resistance to manually pivoting child lock lever 162.

Figure 13:
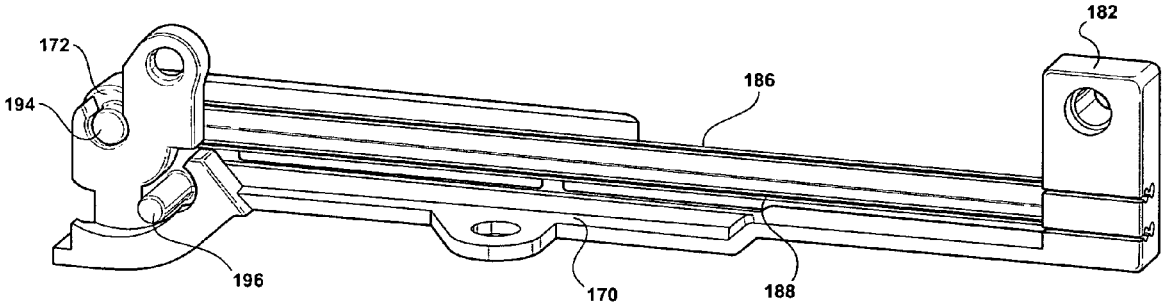
FIG. 13 is an isolated perspective view of a different SMA subassembly mounted within the latch shown in FIG. 11.
Figure 14:
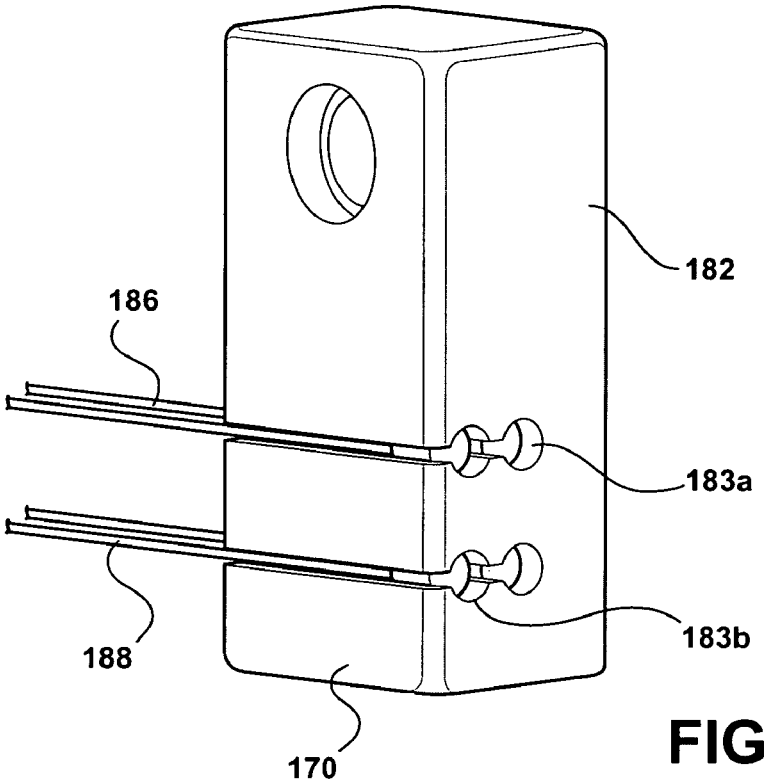
FIG. 14 is an isolated perspective view of the terminal end of the SMA subassembly shown in FIG. 13.
Figure 15:
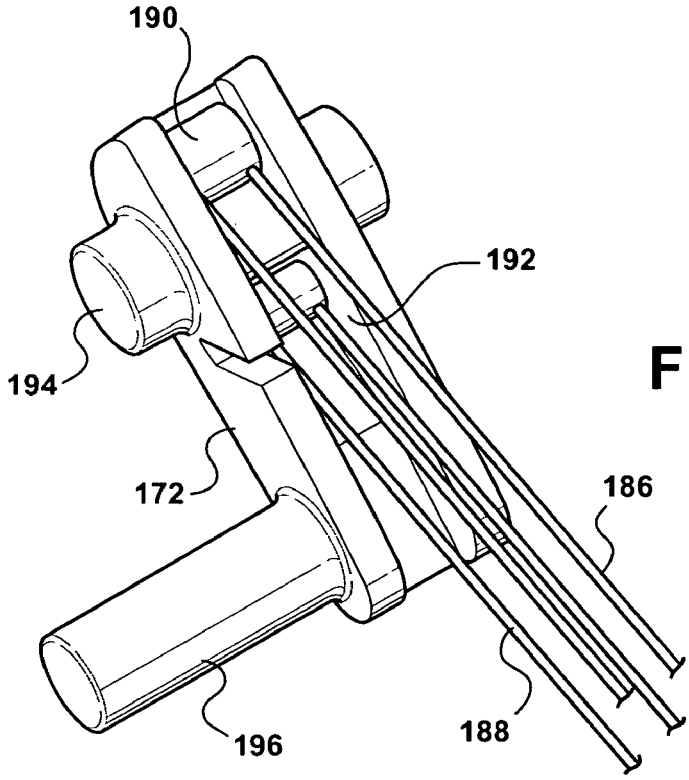
FIG. 15 is an isolated perspective view of the power child lock lever mounted to the SMA subassembly shown in FIG. 13.

Referring now to FIGS. 13-15, a fourth embodiment of the invention is shown. In this embodiment, a SMA wire pair 186 and a SMA wire pair 188 run between terminal end 182 of SMA subassembly 170 and power child lock lever 172. The two wires of each SMA wire pair 186 and 188 run substantially parallel to each other. At terminal end 182, the ends of both wires in each of SMA wire pair 186 and 188 are connected to terminals (not shown) located in terminal receptacles 183*a* and 183*b* respectively. At power child lock lever 172, the ends of both wires in each SMA wire pair 186 and 188 are connected to each other by a conductive metal crimp 190 held within a niche 192 in power child lock lever 172, making each of SMA wire pairs 186 and 188 completed circuits. Actuation strength is thusly increased by pairing each of the SMA wires over using a single SMA wire. Additionally, since terminals are only required at terminal end 182, the cost and complexity of latch 160 are reduced. In this embodiment, power child lock lever 172 pivots around SMA subassembly 172 on a pair of posts 194, and is kinematically coupled with child lock lever 162 via an extending post 196.

The child locks described above are electrically actuated and therefore can be remotely activated from anywhere inside or outside of the vehicle. This eliminates the need for the driver to get out of the car to open the rear doors from the outside. Instead, the driver can actuate a button located in the front passenger area or on a key fob remote controller. Another advantage provided by the first two embodiments described above is that the latch requires comparatively less packaging space because the child lock assembly is part of the inside release handle and is not located on the latch itself. There is more room to package the child lock in this part of the door. The use of the shape memory alloy actuator is also cost-effective in that it replaces the conventional electric actuator having a motor, gears and a housing. The preferred embodiments described above are also a satisfactory from a "craftsmanship" point of view since they have less moving parts and eliminate noise emanating from motors and gears of conventional power actuators. Furthermore, there are no levers that need to be manually operated.

The SMA wire is preferably formed from an alloy comprising nickel and titanium, commercially available under the trade name Nitinol™. Other types of alloys may be employed in the alternative. For example, a ternary shaped memory alloy comprising nickel, titanium and either palladium or hafnium could be used to form the SMA wire. It will also be understood that where one contiguous SMA wire has been shown wrapped around a toggle mechanism, two separate SMA wires be used in the alternative. For extended longevity of the SMA actuator, the latter option, two separate wires, is preferred. It has been found that the use of one long wire which is wrapped around a post or other structure tends to become brittle after many operational cycles, possibly due to the friction between the SMA wire and the post. Accordingly, in the most preferred embodiments it is desirable that the SMA wire is linearly routed so as to not contact any other part of the latch (except at the ends of the wire where electrical contact is made) in order to preclude this problem.

Those skilled in the art will understand that a variety of modifications may be made to the embodiments described herein without departing from the spirit of the invention.

The invention claimed is:

1. A child lock assembly for enabling and disabling operation of an automotive vehicle door handle lever, said child lock assembly comprising:

a housing;

a manually operated child lock lever pivotally mounted to said housing and operatively coupled to the vehicle door handle lever, said child lock lever movable between an unlocked position enabling operation of said door handle lever and an unlocked position disabling operation of said door handle lever, said child lock lever including a knob protruding from said housing for manually actuating said child lock lever between said locked and unlocked positions;

a power child lock lever pivotally mounted to said housing, said power child lock lever including a claw for engaging a post extending from said child lock lever thereby kinematically coupling said child lock lever and said power child lock lever to pivot together; and at least first and second selectively contractible wires, each of said first and second wires extending between a first end connected to said housing and a second end connected to said power child lock lever, whereby a controller, connected to a voltage source, electrically activates one of said first and second wires to pivot said power child lock lever in a first direction and electrically activates the other one of said first and second wires to pivot said power child lock lever in a second direction, thereby causing said child lock lever to pivot between said locked and unlocked positions.

2. A child lock assembly as set forth in claim 1 wherein each of said first and second wires is formed from a shaped memory alloy.

3. A child lock assembly as set forth in claim 2 including first terminals connecting said first end of each of said first and second wires to said housing and second terminals connecting said second end of each of said first and second wires to said power child lock lever.

4. A child lock assembly as set forth in claim 3 including a mounting structure mounted to said housing, said power child lock lever pivotally mounted to said mounting structure, said mounting structure including a terminal end spaced apart from said power child lock lever.

5. A child lock assembly as set forth in claim 4 wherein said first terminals connect said first end of each of said first and second wires to said terminal end of said mounting structure and said second terminals connect said second end of each of said first and second wires to said power child lock lever.

6. A child lock assembly as set forth in claim 1 wherein said at least first and second selectively contractible wires include a first wire pair extending between first and second ends and a second wire pair extending between first and second ends.

7. A child lock assembly as set forth in claim 6 wherein each of said first and second wire pairs include two wires extending substantially parallel to one another.

8. A child lock assembly for enabling and disabling operation of an automotive vehicle door handle lever, said child lock assembly comprising:

a housing;

a manually operated child lock lever pivotally mounted to said housing and operatively coupled to the door handle lever, said child lock lever movable between an unlocked position enabling operation of the door handle lever and a locked position disabling operation of the door handle lever;

a power child lock lever pivotally mounted to said housing and directly engaging said child lock lever thereby kinematically coupling said child lock lever and said power child lock lever to pivot together; and at least first and second selectively contractible wires each having one end connected to said power child lock lever, whereby a controller, connected to a voltage source, electrically activates one of said first and second wires to pivot said power child lock lever in a first direction and electrically activates the other one of said first and second wires to pivot said power child lock lever in a second direction, thereby causing said child lock lever to pivot between said locked and unlocked positions.

9. A child lock assembly as set forth in claim 8 wherein said at least first and second selectively contractible wires include a first wire pair extending between first and second ends and a second wire pair extending between first and second ends.

10. A child lock assembly as set forth in claim 9 wherein each of said first and second wire pairs include two wires extending substantially parallel to one another.

11. A child lock assembly as set forth in claim 10 wherein said child lock lever including a knob protruding from said housing for manually actuating said child lock lever between said locked and unlocked positions.

* * * * *